US007726169B2

(12) United States Patent
Barkich

(10) Patent No.: US 7,726,169 B2
(45) Date of Patent: Jun. 1, 2010

(54) METHOD OF ASSESSING THE PERFORMANCE OF A STEAM GENERATOR

(75) Inventor: Jonathan L. Barkich, Pittsburgh, PA (US)

(73) Assignee: Westinghouse Electric Co. LLC, Cranberry Township, PA (US)

( * ) Notice: Subject to any disclaimer, the term of this patent is extended or adjusted under 35 U.S.C. 154(b) by 457 days.

(21) Appl. No.: 11/669,194

(22) Filed: Jan. 31, 2007

(65) Prior Publication Data

US 2007/0181082 A1 Aug. 9, 2007

Related U.S. Application Data

(60) Provisional application No. 60/765,564, filed on Feb. 6, 2006.

(51) Int. Cl.
*G01D 18/00* (2006.01)

(52) U.S. Cl. ..... 73/1.01

(58) Field of Classification Search ..... 73/1.01; 122/459

See application file for complete search history.

(56) References Cited

U.S. PATENT DOCUMENTS 3,512,412 A * 5/1970 Weining ..... 73/295
4,403,500 A * 9/1983 Le Baud ..... 73/19.05
4,552,098 A * 11/1985 Wynnyckyj et al. ..... 122/379
5,533,383 A * 7/1996 Greene et al. ..... 73/40.5 A
6,973,396 B1 * 12/2005 Shah et al. ..... 73/660

* cited by examiner

*Primary Examiner*—Hezron Williams
*Assistant Examiner*—Alex Devito

(57) ABSTRACT

A grading system for a pressurized water reactor steam generator secondary side performance that provides a cumulative assessment of tube bundle deposit inventory and characteristics, i.e., scale density and distribution, hard scale collar formation, thermal performance, loose parts management, and steam generator secondary side chemistry performance. Results are summarized in a cumulative quality point average with individual parameter ratings available so that specific performance improvement may be achieved.

15 Claims, 1 Drawing Sheet

METHOD OF ASSESSING THE PERFORMANCE OF A STEAM GENERATOR

CROSS REFERENCE TO RELATED APPLICATIONS

This application claims priority to Provisional Application Ser. No. 60/765,564, filed Feb. 6, 2006.

BACKGROUND OF THE INVENTION

1. Field of the Invention

The invention relates to steam generators for nuclear power plants and, more particularly, to a method of assessing the servicing needs of such a steam generator.

2. Background

A nuclear steam generator comprises a vertically oriented shell, a plurality of U-shaped tubes disposed in the shell so as to form a tube bundle, a tube sheet for supporting the tubes at the ends opposite the U-like curvature, a dividing plate that cooperates with the tube sheet and a hemispheric channel head to form a primary fluid inlet header at one end of the tube bundle and a primary fluid outlet header at the other end of the tube bundle. A primary fluid inlet nozzle is in fluid communication with the primary fluid inlet header and a primary fluid outlet nozzle is in fluid communication with the primary fluid outlet header. The steam generator secondary side comprises a wrapper disposed between the tube bundle and the shell to form an annular chamber made up of the shell on the outside of the wrapper on the inside, and a feedwater ring disposed above the U-like curvature end of the tube bundle.

The primary fluid having been heated by circulation through the reactor core enters the steam generator through the primary fluid inlet nozzle. From the primary fluid inlet nozzle, the primary fluid is conducted through the primary fluid inlet header, through the U-tube bundle, out the primary fluid outlet header, through the primary fluid outlet nozzle to the remainder of the reactor system. At the same time, feedwater is introduced to the steam generator secondary side through a feedwater nozzle which is connected to the feedwater ring inside the steam generator. Upon entering the steam generator, the feedwater mixes with water returning from moisture separators positioned above the U-tube bundle, referred to as the recirculation stream. This mixture, called the downcomer flow, is conducted down the annular chamber adjacent to the shell between the shell and the wrapper until the tube sheet near the bottom of the annular chamber causes the water to reverse direction, passing in heat transfer relationship with the outside of the U-tubes and up through the inside of the wrapper. While the water is circulating in heat transfer relationship with the tube bundle, heat is transferred from the primary fluid in the tubes to the water surrounding the tubes, causing a portion of the water to be converted to steam. The steam then rises and is conducted through a number of moisture separators that separate any entrained water from the steam, and the steam vapor then exits the steam generator and is circulated through typical electrical generating equipment to generate electricity in a manner well-known in the art.

Loose parts may enter the steam generator through the feedwater stream and can cause damage to the heat transfer tubes in the tube bundle. This damage can results in having to plug or repair the damaged tubes to avoid contamination of the secondary fluid. In extreme cases, the damage can lead to a tube leak and forced outage with significant expense to the plant. Therefore, it is important to prevent foreign objects from entering the steam generator and/or to remove the loose parts from the steam generator before damage occurs. Copending application Ser. No. 11/563,742, filing date Nov. 28, 2006, describes one means of trapping the loose parts so that they do not enter the tube bundle. However, periodic maintenance is still required to remove the loose parts from the trapping mechanism before it becomes ineffective.

In addition, the tube bundle has as number of parallel support plates that are arranged in tandem and spaced along the longitudinal length of the bundle, through which the heat exchange tubes pass and are supported against vibration. The contact area between the tubes and the tube support plates tend to be hot with respect to the surrounding environment. The secondary water circulating in the steam generator tends to dissipate this heat if it is permitted to flow directly against the contact areas. However, fine particles of magnetite formed at relatively high temperatures within the circulating secondary water tend to collect and build up sludge patches about the tube openings, particularly the contact areas, thus preventing the secondary water direct access to the contact areas and the dissipation of heat therefrom. As the sludge patches build up, non-volatile impurity accumulation occurring at the contact areas is not washed away by the circulating secondary water, thus leading to dry-out and corrosion of the contact areas. It is desirable periodically to decrease the sludge patches to minimize this corrosive effect. In addition, due to the change of phase of the liquid on the secondary side form water to steam, tube sheet scale builds up around the tubes and forms a collar which can similarly result in corrosion. Furthermore, the change in phase results in a sludge that reduces the efficiency of the generator. Therefore, it is highly desirable to service the generators at periodic intervals to reduce the deleterious effects of the foregoing foreign matter that collects on the secondary side.

Unless there is a significant break in the stream generator tubes, the steam generators are typically serviced when the plant is shut down for other reasons that absolutely necessitate shuttling down the system, because of the expense of replacement power. Typically, outages occur at the end of the refueling cycles. However, even then, it may not be necessary to bear the expense of servicing any or all of the steam generators at each refueling outage if a system could be developed for assessing the performance of the steam generator.

Accordingly it is the object of this invention to develop a method of assessing the performance of a steam generator that will enable a plant operator to determine when and what kind of service is required based upon the operating expectations of the plant.

SUMMARY OF THE INVENTION

This invention provides a grading system for pressurized water reactor steam generator secondary side performance. The grading system of this invention may provide accumulative assessment of tube bundled deposit inventory and characteristics; i.e., scale density and distribution, hard scale collar formation, thermal performance, loose parts management and steam generator secondary side chemistry performance. Results may be summarized in a cumulative quality point average with individual parameter ratings available so that specific performance improvement may be achieved. The system may be tailored to individual steam generator design characteristics and individual utility performance criteria while maintaining the ability to compare performance against a common standard for any steam generator type.

In accordance with this invention, the method identifies a set of parameters to be measured for performance assessment.

A criterion is established for levels of performance for each parameter in the set of parameters. The performance of the steam generator is measured for each of the parameters during operation, if applicable, or during an outage. The measured performance is then compared for each parameter to the criteria for levels of performance. The measured performance for each parameter is then converted to a number grade associated with an applicable criterion for a level of performance. A comprehensive number grade is then calculated for each parameter and the comprehensive grade and/or some or all of the individual numbered grades are utilized to assess the performance of the steam generator.

In the preferred embodiment, the parameters to be measured for performance assessment are chosen from the group comprising: tube scale accumulation on the steam generating side of the steam generator; tube sheet scale collar accumulation on the steam generating side of the steam generator; number and size distribution of foreign objects observed on the steam generating side of the steam generator; steam generator sludge quantity on the steam generating side of the steam generator; steam generator sludge distribution on the steam generating side of the steam generator; full power main steam pressure during steam generator operation; steam generator fouling factor; and selected operating chemistry parameters. The fouling factor is a term well known in the art and is a factor calculated from the thermodynamic data that accounts for any degrading in the heat transfer efficiency between the primary and secondary side of the steam generator. The selected operating chemistry parameters are further chosen from the group comprising feedwater iron, copper and lead concentrations.

Preferably, the utilizing step is performed for each parameter may be maintenance operations. The levels of performance for each parameter may be excellent, good, average or poor, or the levels of performance may be assigned a letter grade. Desirably, the grades can be broken down into three or more levels with a larger number of grades providing a finder assessment. The grades may also be weighted, based upon the effect of the corresponding criteria on degrading the steam generator's operation. The utilizing step may then utilize the comprehensive number and/or the parameter number grades to prioritize service needs among the nuclear island components, or even within the secondary side of the generator. The service needs may be maintenance operations or may involve operational enhancement opportunities.

BRIEF DESCRIPTION OF THE DRAWINGS

A further understanding of the invention can be gained from the following description of the preferred embodiments when read in conjunction with the accompanying drawing in which.

DESCRIPTION OF THE PREFERRED EMBODIMENT

Figure 1:
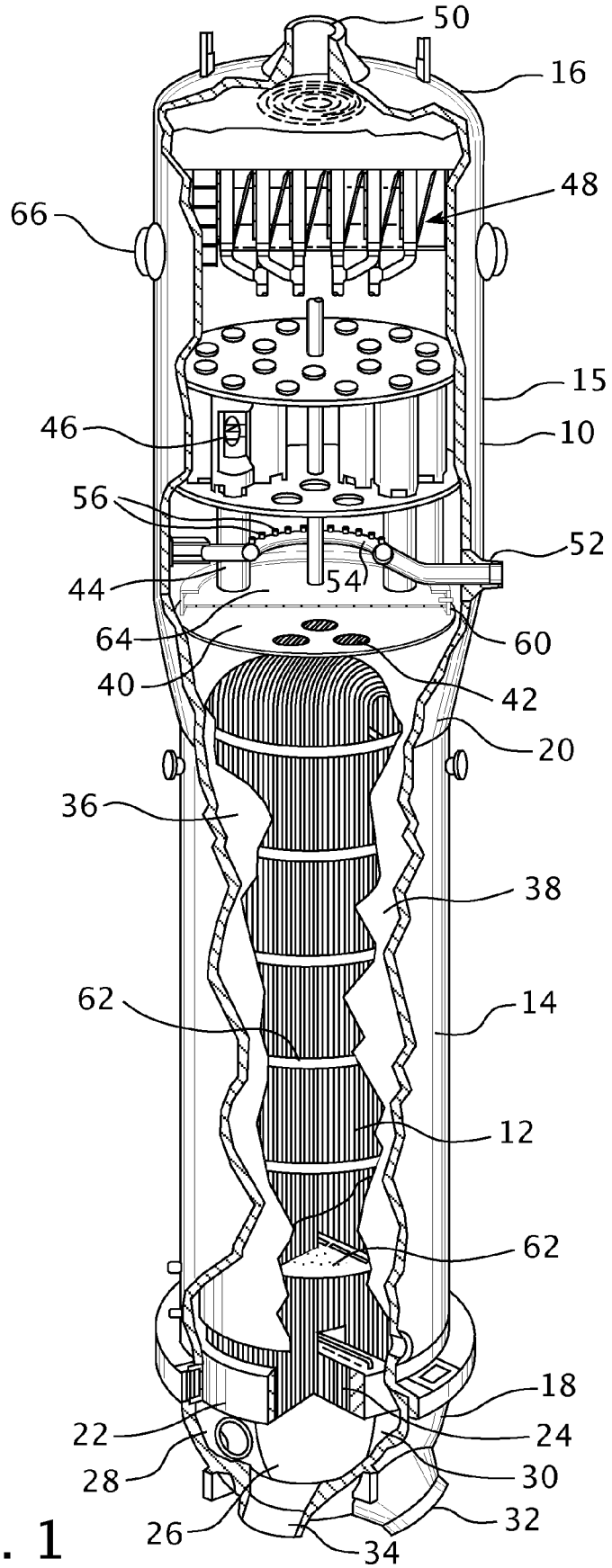
FIG. 1 is a perspective view, partially cut away, of a vertical steam generator for which the method of this invention may be applied.

Referring now to the drawing, FIG. 1 shows a steam or vapor generator 10 that utilizes a plurality of U-shaped tubes which form a tube bundle 12 to provide the heating surface required to transfer heat from a primary fluid traveling within the tubes to vaporize or boil a secondary fluid surrounding the outside of the tubes. The steam generator 10 comprises a vessel having a vertically-oriented tubular shell portion 14 and a top enclosure or dished head 16 enclosing the upper end and a generally hemispherical shaped channel head 18 enclosing the lower end. The lower shell portion 14 is smaller in diameter than the upper shell portion 15 and a sheet 22 is attached to the channel head 18 and has a plurality of holes 14 disposed therein to receive ends of the U-shaped tubes. A dividing plate 26 is centrally disposed within the channel head 18 to divide the channel head into two compartments 28 and 30, which serve as headers for the tube bundle. Compartment 30 is the primary fluid inlet compartment and has a primary fluid inlet nozzle 32 in fluid communication therewith. The compartment 28 is the primary fluid outlet compartment and has a primary fluid outlet nozzle 34 in fluid communication therewith. Thus, primary fluid, i.e., the reactor coolant, which enters fluid compartment 30 is caused to flow through the tube bundle 12 and out through outlet nozzle 34.

The tube bundle 12 is encircled by a wrapper 36 which forms an annular passage 38 between the wrapper 36 with the shell and cone portions 14 and 20, respectively. The top of the wrapper 36 is covered by a lower deck plate 40 which includes a plurality of openings 42 in fluid communication with a plurality of riser tubes 44. Swirl vanes 46 are disposed within the riser tubes to cause steam flowing therethrough to spin and centrifugally remove some of the moisture contained within the steam as it flows through the primary centrifugal separator. The water separated from the steam in this primary separator is returned to the top surface of the lower deck plate. After flowing through the primary centrifugal separator, the steam passes through a secondary separator 48 before reaching a steam outlet 50 centrally disposed in the dished head 16.

The feedwater inlet structure of this generator includes a feedwater inlet nozzle 52 having a generally horizontal portion called a feedring 54 and discharge nozzles 56 elevated above the feedring. Feedwater supplied through the feedwater inlet nozzle 52 passes through the feedring 54 and exits through discharge nozzles 56 and mixes with water which was separated from the steam and is being recirculated. The mixture then flows down above the lower deck plate 40 into the annular passage 38. The water then enters the tube bundle at the lower portion of the wrapper 36 and flows along and up the tube bundle where is it heated to generate steam.

The hydraulic flow among the tube bundle and the change of phase from liquid to vapor of the secondary side feedwater causes meaningful vibration among the tubes within the tube bundle 12. Support plates 62 are arrange in tandem at spaced elevations along the tube bundle 12 and respectively have holes through which the corresponding tubes pass and are supported. During operation and as a result of the change of phase of the secondary side feedwater, a number of deposits form on the tube bundle 12, tube sheet 22 and the support plates 62. The deposits on the support plates can impair the flow of coolant through the support holes within the support plates 62 and reduce the efficiency of the heat transfer process. In addition, these deposits which form around the base of the tube sheet 22 and adjacent to tubes on the support plates can result in the development of an environment corrosive to the tubes which can corrode and eventually breach the barrier between the primary and secondary sides of the steam generator.

Furthermore, a loose parts collector weir 60, which is more fully described in co-pending application Ser. No. 11/563,742, filed Nov. 28, 2006, is employed on the lower deck plate 40. The loose parts collector weir 60 is a nearly cylindrical wall structure that is interior to the upper drum; i.e., the interior volume above the lower deck plate 40 of the steam generator 10, to retain loose parts along the transit path from the feedwater discharge nozzle 56 to the tube bundle 12.

Furthermore, a loose parts collector weir 60, which is more fully described in co-pending application Ser. No. 11/563,742, filed Nov. 28, 2006, is employed on the lower deck plate 40. The loose parts collector weir 16 is a nearly cylindrical wall structure that is interior to the upper drum; i.e., the interior volume above the lower deck plate 40 of the steam generator 10, to retain loose parts along the transit path from the feedwater discharge nozzle 56 to the tube bundle 12.

In addition, some operating generators have sludge collectors 64 integrated with the lower deck plate 40. The sludge collectors form settling ponds that permit solids entrained in the circulated coolant from the moisture separators to settle out.

Periodically, the sludge collectors have to be cleaned to retain their sludge collecting capability. During refueling outages, the secondary sides of the steam generators are accessed through manways such as the manways 66 in the upper shell 15 to gain access to the lower deck plate 40 to clean the mud drum 64 and loose parts weir 60. Similarly, access is provided through lower handholes (not shown) above the tube sheet to sludge lance and thus clean the tube sheet 22 and the support plates 62. It is not necessary to service every steam generator at every outage, and the less exposure to the interior of the generators reduces the radiation exposure to there service personnel. Thus, it would be highly desirable to have a cumulative assessment of the tube bundle and lower deck plate, deposit inventory and characteristics; i.e., scale density and distribution, hard scale collar formation around the base of the tubes at the tube sheet, thermal performance, loose parts management, and steam generator secondary side chemistry performance. This invention provides such an assessment that may be summarized in a cumulative quality point average with individual parameter ratings available so that specific performance improvements may be achieved. The system may be tailored to individual steam generator design characteristics and utility needs while maintaining the ability to compare performance against a common standard for any steam generator type.

There is currently no such rating system available. Engineers evaluating steam generator performance typically use hard data to describe performance conditions; e.g., psi of steam pressure, pounds of corrosion product accumulation and quantity and ratio of chemical hideout return, i.e., the ratio of impurities in solution, etc. While these parameters are still evaluated individually, it is the individual numerical rankings and cumulative averaging of these numerical rankings that provides a novel additional benefit in the steam generator performance assessment area.

Accordingly, the method of this invention for assessing the performance of a steam generator identifies a set of parameters to be measured for the performance assessment. Criteria levels of performance are established for each parameter in the set of parameters. Each of these parameters are measured during operation, if applicable, or during an outage. If a particular parameter cannot be measured at the interval in which the measurements are taken, then that particular parameter may be either extrapolated from values taken during the previous measurement periods or left out of the comprehensive grade. The measured parameters are then compared to the criteria for levels of performance for the corresponding parameters. Each level of performance is then converted to a number grade with an applicable criteria for a level of performance. A comprehensive number grade may then be calculated from the number grade for each parameter. The comprehensive grade and the individual number grades for at least some of the parameters are the used to assess the performance of the steam generator. The parameters to be measured are chosen from the following group: tube scale accumulation on the steam generating side of the steam generator; degree of tube hole blockage in the support plates on the steam generating side of the steam generator; tube sheet scale collar accumulation on the steam generating side of the steam generator; number and size distribution of foreign objects (loose parts) observed on the steam generating side of the steam generator; steam generator sludge quantity on the steam generating side of the steam generator; steam generator sludge distribution on the steam generating side of the steam generator; full power main steam pressure during steam generator operation, steam generator fouling factor and selected operating chemistry parameters. Of course, other parameters that provide information on steam generator performance may be added to the foregoing list. For example, the selected operating chemistry parameters may be the feedwater iron, copper and lead concentrations. Some or all of these parameters may be used as long as the parameters used are consistent for each measurement. In the preferred embodiment, the following parameters are employed:

1. tube scale accumulation (pounds accumulated in the U-bend region, straight length and the top of the tube sheet);
2. degree of broach hole blockage (percent blocked broached hole lands and lobes;
3. tube sheet scale collar accumulation: percent of locations with collar formation;
4. number and type of loose parts;
5. scale composition (percent of detrimental metals, concentration of corrosive chemicals and scale porosity);
6. feedwater chemistry (iron transport quantity, integrated impurity exposure quantity, hideout return chemical quantity and pH, etc.) and
7. thermal performance characteristics (steam pressure, boiling heat transfer coefficient, fouling factor).

These and/or other similar parameters can be quantified and graded on a scale from poor (1), acceptable/needs improvement (2), good (3) to excellent (4). Alternatively, a letter grade can be associated with each number grade. Furthermore, the grades can be expanded to more than four to give a finer indication, although any significant expansion may not have much meaning since a number of the parameters considered are measured subjectively. The numeric values for these parameters may be plant or steam generator design specific, and therefore are not included in this example. If important parameters are not measured or included in the cumulative average, a deduction may be made to account for inadequate data collection or the missing parameter values may be extrapolated from previous measurements.

A grading scheme using a composite assessment of various parameters provides an output matrix that can capture the essential elements of the assessment operation. Each parameter can be graded on a numeric scale from poor to excellent; e.g., 1-4 as mentioned above. An average of all the individual parameter ratings can be determined to provide a cumulative quality point average. For example, a grading scheme may comprise the following parameters:

1. Tube Scale Accumulation
a. grade 4—less than 1,000 pounds
b. grade 3—between 1,000 and 2,000 pounds
c. grade 2—between 2,000 and 3,000 pounds
d. grade 1—greater than 3,000 pounds
2. Degree of Broach Blockage
a. grade 4—no observed blockage
b. grade 3—less than 5% observed blockage
c. grade 2—between 5% and 10% observed blockage
d. grade 1—greater than 10% observed blockage 3. Tube Sheet Scale Collar Accumulation
a. grade 4—no observed collars
b. grade 3—less than 5% observed collars
c. grade 2—between 5% and 10% observed collars
d. grade 1—greater than 10% observed collars
4. Number and Type of Loose Parts
a. grade 4—no observed loose parts
b. grade 3—no metal objects
c. grade 2—several small metal objects with up to one larger metal object
d. grade 1—several large metal objects
5. Scale Composition
a. grade 4—porous magnetite scale
b. grade 3—less porous magnetite scale
c. grade 2—dense magnetite scale or scale with copper/lead/aluminum/silica/etc.
d. grade 1—dense scale with copper/lead/aluminum/silica/etc.
6. Feedwater Chemistry
a. grade 4—iron<1 ppb, copper and lead not detected
b. grade 3—iron 1-5 ppb, copper and lead not detected
c. grade 2—iron 1-5 ppb, copper and/or lead>0.5 ppb
d. grade 1—iron>5 ppb, copper and/or lead>5 ppb
7. Thermal Performance Characteristics
a. grade 4—main steam pressure and fouling factor steady or improving; main steam throttle valves not wide open
b. grade 3—main steam pressure and fouling factor degrading; main steam throttle valves not wide open
c. grade 2—main steam pressure and fouling factor degrading; main steam throttle valves wide open
d. grade 1—main steam pressure and fouling factor degrading; main steam throttle valves wide open and plant is unable to achieve full power In this example, a cumulative quantity point average of 2.5 or less is chosen as an indication that cleaning is required. Some utilities may choose to run their generators at a higher efficiency than others, so this number may vary with the philosophy of the utility. If an examination of the steam generator indicates that there are between 1,000 and 2,000 pounds of scale, 5-10% observed broach hole blockages and greater than 10% observed tube sheet scale collars, and these were the only parameters chosen for the assessment, the grading may be calculated as (3+2+1)/3=2. Because the average exceeds 2.5 in this example, the invention indicates that cleaning is required and that cleaning scale collars and broach hole blockages will provide the most benefits. In other grading schemes, the various parameters may be differently weighted and/or different averages may be calculated, depending on the preference of the utility. However, a standard can be generated for each type of steam generator that utilities can take advantage of to compare their operating results.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of their invention which is to be given the full breadth of the appended claims and nay and all equivalents thereof.

What is claimed is:

1. A method of assessing the performance of a steam generator to determine its maintenance status, comprising the steps of: identifying a set of a plurality of different parameters to be measured for performance assessment of the steam generator with at least some of the parameters measured with the steam generator off-line during and outage, wherein the at least some of the parameters measured with the steam generator off-line include at least one of (i) tube scale accumulation on a steam generating side of the steam generator, (ii) degree of tube hole blockage in support plates on the steam generating side of the steam generator, (iii) tube sheet scale collar accumulation on the steam generating side of the steam generator and (iv) steam generator sludge quantity on the steam generating side of the steam generator; establishing criteria for levels of performance for each parameter in the set of parameters; measuring performance of the steam generator on each of these parameters; comparing measured performance for each parameter to the criteria for levels of performance; converting the measured performance for each parameter to a number or letter grade associated with an applicable criteria for a level of performance; calculating a cumulative average number or letter grade from the number or letter grade for each parameter; and utilizing the cumulative average grade and the number or letter grades for at least some of the parameters to assess the performance of the steam generator.

2. The method of claim 1 wherein the parameters to be measured, if not already included further include parameters chosen from the group comprising: tube scale accumulation on the steam generating side of the steam generator; degree of tube hole blockage in support plates on the steam generating side of the steam generator; tube sheet scale collar accumulation on the steam generating side of the steam generator; number and size distribution of foreign objects observed on the steam generating side of the steam generator; steam generator sludge quantity on the steam generating side of the steam generator; steam generator sludge distribution on the steam generating side of the steam generator; full power main steam pressure and fouling factor during steam generator operation; and selected operating chemistry parameters.

3. The method of claim 2 wherein the selected operating chemistry parameters are chosen from the group comprising feedwater iron, copper and lead concentrations.

4. The method of claim 1 wherein the utilizing step is performed during refueling outage maintenance operations.

5. The method of claim 1 wherein the levels of performance for each parameter are excellent, good, average, poor or a letter grade.

6. The method of claim 1 wherein the utilizing step utilizes the cumulative average grades and parameter number grades by averaging the parameter number grades to form the cumulative average grade as a measure of steam generator performance.

7. The method of claim 6 wherein the parameter number grades are weighted according to their overall importance to the assessment before being averaged.

8. The method of claim 1 wherein the utilizing step utilizes the cumulative average number and the parameter number grades to prioritize maintenance service tasks.

9. The method of claim 8 wherein the service needs are maintenance operations.

10. The method of claim 8 wherein the service needs are operational enhancement opportunities.

11. The method of claim 1 wherein the measurement of at least some of the parameters can be obtained by sampling the parameters being measured.

12. The method of claim 11 wherein the sampling taken for a particular parameter is consistent at each measurement period in which a measurement is taken.

13. The method of claim 12 wherein a measurement of a tube hole blockage in a support plate is consistently taken for a same tube hole at each measurement period for which such a measurement is made.

14. The method of claim 1 wherein if at a measurement period a particular measurement can not be obtained for a particular parameter then the method includes extrapolating from previous measurements for that particular parameter to obtain a value for the measurement period.

15. The method of claim 1 wherein if important parameters are not measured or included in the cumulative average, a deduction is made to account for inadequate data collection.

* * * * *